US006851629B2

(12) United States Patent
Stier et al.

(10) Patent No.: US 6,851,629 B2
(45) Date of Patent: Feb. 8, 2005

(54) FUEL INJECTION VALVE

(75) Inventors: Hubert Stier, Asperg (DE); Joerg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 148 days.

(21) Appl. No.: 10/149,304

(22) PCT Filed: Oct. 10, 2001

(86) PCT No.: PCT/DE01/03846

§ 371 (c)(1),
(2), (4) Date: Nov. 11, 2002

(87) PCT Pub. No.: WO02/31343

PCT Pub. Date: Apr. 18, 2002

(65) Prior Publication Data

US 2003/0111562 A1 Jun. 19, 2003

(30) Foreign Application Priority Data

Oct. 10, 2000 (DE) ..... 100 50 055

(51) Int. Cl.[7] ..... B05B 1/30; F02M 39/00; F02M 61/00

(52) U.S. Cl. ..... 239/585.1; 239/585.3; 239/585.5; 239/533.3; 239/533.12; 239/533.14

(58) Field of Search ..... 239/585.1–585.5, 239/533.2, 533.3, 533.9, 533.12, 533.14, 88–93, 461, 469, 470, 483; 251/129.15, 129.21

(56) References Cited

U.S. PATENT DOCUMENTS

| | | | | | |
|---|---|---|---|---|---|
| 2,981,483 | A | * | 4/1961 | Pichon | 239/464 |
| 4,520,962 | A | * | 6/1985 | Momono et al. | 239/488 |
| 5,484,108 | A | * | 1/1996 | Nally | 239/553.3 |
| 6,330,981 | B1 | * | 12/2001 | Nally et al. | 239/533.12 |

FOREIGN PATENT DOCUMENTS

| | | | | |
|---|---|---|---|---|
| DE | 31 21 572 | | 12/1982 | |
| DE | 42 00 709 | | 7/1993 | |
| FR | 1 358 593 | | 4/1964 | |
| GB | 137 134 | | 1/1920 | |
| JP | 59 015 668 | | 1/1984 | |
| SU | 1359463 | A * | 12/1987 | F02M/17/00 |

* cited by examiner

*Primary Examiner*—Davis Hwu
(74) *Attorney, Agent, or Firm*—Kenyon & Kenyon

(57) ABSTRACT

A fuel injector (1) for fuel injector systems of internal combustion engines has a valve-closure member (4) which is mechanically linked to a valve needle (3) and cooperates with a valve-seat surface (6) of a valve-seat member (5) to form a sealing seat. A turbulence-producing element is provided in the valve-seat member (5), situated downstream from the sealing seat, and its center line (38) preferably forms an angle different from zero with the center line (39) of the fuel injector (1), a threaded rod (36) being pressed into the valve-seat member (5) as the turbulence-producing element.

9 Claims, 2 Drawing Sheets

FUEL INJECTION VALVE

FIELD OF THE INVENTION

The present invention relates to a fuel injector.

BACKGROUND INFORMATION

Fuel injectors having an element to produce turbulence downstream from a sealing seat are German Published Patent Application No. 31 21 572. A cylindrical component having grooves in the cylindrical lateral surface joining the two cylinder end faces is pressed into a borehole situated coaxially with the center line of the fuel injector and leading from a sealing seat to the injection orifice. These grooves are arranged in a spiral and impart a turbulence to the fuel flow when the fuel injector is opened. To implement various fuel jet injection patterns, the grooves may be adapted with regard to their cross-section and pitch. Metering of the injected fuel is also adjusted via the grooves, which are supplemented by the valve-seat member to form closed swirl channels.

Another fuel injector is known from U.S. Pat. No. 4,520,962. Downstream from a ball valve there is a rod in whose surface grooves are provided. These grooves are also arranged in a spiral to produce turbulence and are supplemented by the valve-seat member to form closed swirl channels. An injection orifice which widens in the form of a cone is connected directly downstream.

One disadvantage of the known fuel injectors is the complicated manufacturing of the cylindrical swirl insert. It is expensive and time-consuming to produce the individual swirl grooves. Machining technologies are generally used, and remachining is also necessary because of the burrs formed when cutting the grooves.

The high precision required to prevent the development of a secondary flow path also has a negative effect on cost. The swirl insert is sealed with respect to the valve-scat member by maintaining a high-quality roundness tolerance. This results in a fuel flow directed completely through the swirl channels.

SUMMARY OF THE INVENTION

The fuel injector according to the present invention has the advantage over the related art that an inexpensive component for producing a turbulent flow may be used due to the design of swirl channels in the form of the threads of a threaded rod. The swirl insert may be cut to length from long threaded rods having the required number of threads.

Threaded rods are usually produced by roll forming without cutting. This eliminates complicated remachining of the swirl insert.

It is also advantageous that the roundness requirements may be reduced due to a plurality of threads pressed into a borehole. Multiple threads produce a seal with respect to the valve-seat member in the axial direction. Due to the labyrinth seal formed in this way, development of an axial secondary flow path is prevented even in the case of components having a generous tolerance.

For controlled injection of fuel in a direction predetermined by the geometry of the cylinder head, the center line of the borehole may form an angle different from zero to accommodate the swirl insert toward the center line of the fuel injector. Due to the inclination of the entire turbulence-producing unit with respect to the center line of the fuel injector, this eliminates deflection of the turbulent fuel flow with the resulting flow losses.

Homogenizing of the turbulence in the fuel flow may be influenced by a swirl chamber situated downstream from the swirl insert, and thus a change in the injection pattern may be achieved. At the same time, turbulence is increased by the reduction in flow cross-section toward the injection orifice.

In addition, it is also possible to press the swirl insert in from the downstream side of the valve-seat member. Then a cavity is produced upstream from the swirl insert, through which the fuel to be injected is metered.

DETAILED DESCRIPTION

Figure 1:
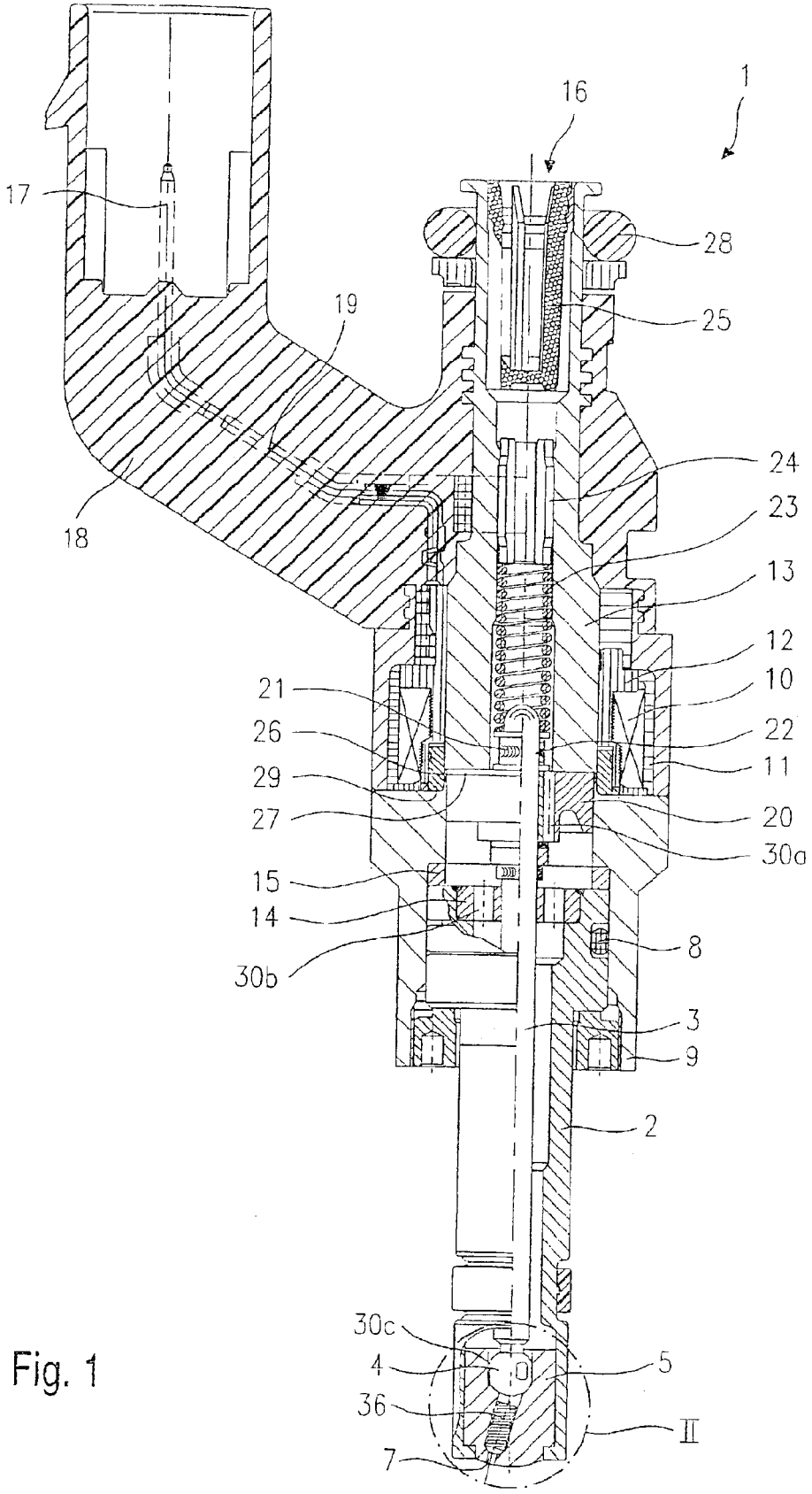
FIG. 1 shows a schematic partial section through a first embodiment of a fuel injector according to the present invention.

Before describing two embodiments of a fuel injector 1 in greater detail with reference to FIGS. 2 and 3, fuel injector 1 according to the present invention will first be explained briefly with respect to its essential components in an overall presentation.

Fuel injector 1 is designed in the form of a fuel injector 1 for fuel injection systems of internal combustion engines having compression of a fuel/air mixture with spark ignition. Fuel injector 1 is suitable in particular for direct injection of fuel into a combustion chamber (not shown) of an engine.

Fuel injector 1 has a nozzle body 2 in which a valve needle 3 is situated. Valve needle 3 is mechanically linked to a valve-closure member 4 which cooperates with a valve-seat surface 6 situated on a valve-seat member 5 to form a sealing seat. In this embodiment, fuel injector 1 is an electromagnetically operated fuel injector 1 having an injection orifice 7. Nozzle body 2 is sealed by a gasket 8 with respect to a stationary pole 9 of a solenoid 10. Solenoid 10 is encapsulated in a coil casing 11 and is wound onto a field frame 12, which is in contact with an internal pole 13 of solenoid 10. Internal pole 13 and stationary pole 9 are separated by a gap 26 and are supported on a connecting component 29. Solenoid 10 is energized by an electric current supplied via an electric plug-in contact 17 over a line 19. Plug-in contact 17 is enclosed in plastic sheathing 8 which may be extruded onto internal pole 13.

Valve needle 3 is guided in a valve needle guide 14, which is designed in the form of a disc. A matching adjusting disc 15 is used to adjust the lift. An armature 20 is situated on the other side of adjusting disc 15. The armature is in friction-locked connection to valve needle 3 via a flange 21, the valve needle being connected to flange 21 by a weld 22, for example. A restoring spring 23 is supported on flange 21 and is under prestress by a sleeve 24 in the present design of fuel injector 1.

Fuel channels 30*a*, 30*b* run in valve needle guide 14 and in armature 20. Fuel is supplied through a central fuel feed 16 and is filtered through a filter element 25. Fuel is directed to the sealing seat through fuel channels 30*c*, which run between valve-closure member 4 and valve-seat member 5 along flattened areas 32 on valve-closure member 4. Fuel injector 1 is sealed by a gasket 28 with respect to a distributor line (not shown).

In the resting state of fuel injector 1, armature 20 is acted upon by restoring spring 23 against its direction of lift via flange 21 on valve needle 3, so that valve-closure member 4 is held in sealing contact with valve-seal surface 6 and valve-closure member 4 is in its downstream lift-limiting end position. On energization of solenoid 10, it creates a magnetic field which moves armature 20 in the direction of lift against the spring force of restoring spring 23. Armature 20 entrains flange 21, which is welded to valve needle 3, and thus valve needle 3 is also entrained in the direction of lift. Valve-closure member 4, which is mechanically linked to valve needle 3, is lifted up from valve-seat surface 6, and fuel reaching the valve sealing seat flows through swirl channels 33 into a swirl chamber 34 and from there to injection orifice 7 and is injected.

When the coil current is turned off, armature 20 drops back away from internal pole 13 after the magnetic field has decayed sufficiently, due to the pressure of restoring spring 23 on flange 21, so that valve needle 3 moves in the direction opposite the direction of lift. Valve-closure member 4 is therefore set down on valve-seat surface 6 and fuel injector 1 is closed.

Figure 2:
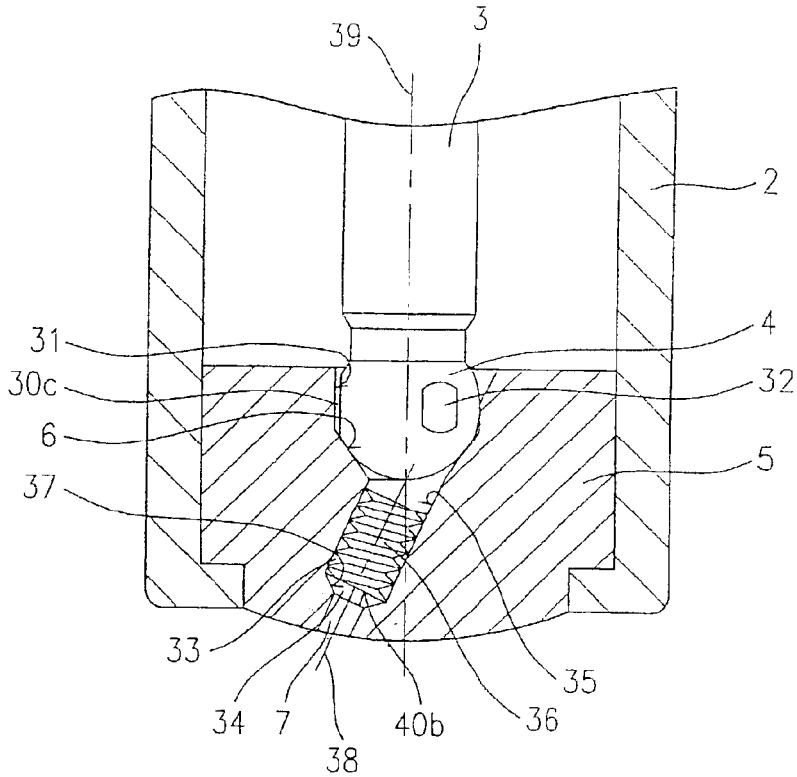
FIG. 2 shows a schematic partial section in detail II of FIG. 1 through the first embodiment of a fuel injector according to the present invention.

FIG. 2 shows a fuel injector 1 according to the present invention. Downstream from the sealing seat, a borehole 35 is introduced into valve-seat member 5 and a threaded rod 36 is pressed into it; downstream of the threaded rod a conical taper 37 follows bore 35, opening into injection orifice 7.

Center line 38 of bore 35 introduced into valve-seat member 5 is preferably inclined at an angle different from zero with respect to center line 39 of fuel injector 1. The diameter of bore 35 corresponds to the outside diameter of threaded rod 36, which is to be pressed into the bore.

The threads of threaded rod 36 are sealed by bore 35 of valve-seat member 5 to form swirl channels 33. At least one complete thread, preferably at least two complete threads run in bore 35. Use of threaded rods 36 having different pitches permits a variation in production of turbulence with the same outside diameter of threaded rod 36 and thus increases the proportion of identical manufactured components in the production of fuel injector 1. Threaded rod 36 is pressed from the upstream side into valve-scat member 5 until its downstream side face **40*b* is in contact with conical taper 37**.

Delimited in the upstream direction from downstream side face **40*b* of threaded rod 36, conical taper 37 forms a swirl chamber 34 and opens downstream into injection orifice 7. Swirl chamber 34 is connected through swirl channels 33 to a cavity formed upstream from threaded rod 36. When fuel injector 1 is opened, fuel enters swirl chamber 34**, where the turbulence is homogenized and intensified due to the narrowing of the cross-section.

Figure 3:
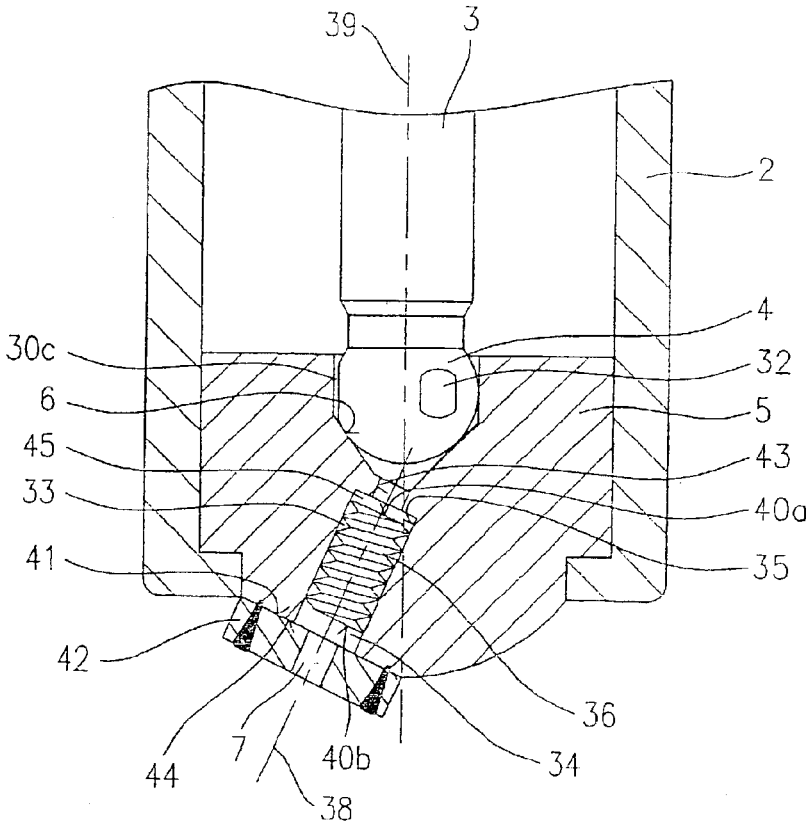
FIG. 3 shows a schematic partial section in detail II of FIG. 1 through a second embodiment of a fuel injector according to the present invention.

FIG. 3 shows a second embodiment of a fuel injector 1 according to the present invention. Threaded rod 36 is pressed from the downstream side into valve-seat member 5. Injection orifice 7 is situated in a spray hole disc 42 which is mounted by welding, for example, on the downstream side of valve-seat member 5.

Downstream from the sealing seat, valve-seat member 5 has an overflow bore whose diameter is smaller than the core diameter of threaded rod 36 to be pressed into the bore, and its center line is preferably identical to center line 38 of a bore 35 which follows in the downstream direction and forms an angle different from zero with center line 39 of fuel injector 1. The diameter of bore 35 corresponds to the outside diameter of threaded rod 36 to be pressed into the bore. The downstream side of bore 35 comes out of valve-seat member 5 on the downstream side. The downstream side of valve-scat member 5 has a preferably planar surface 44 in the area of bore 35, the normal to the surface being identical to the center line of bore 35.

Spray hole disc 42 is mounted by a weld, for example, on valve-seat member 5. Upstream side 41 of spray hole disc 42, which is in contact with face 44 of valve-seat member 5, has a shape corresponding to that of valve-seat member 5. Injection orifice 7 is made in spray hole disc 42 in such a way that the center line of injection orifice 7 is identical to center line 38 of bore 35 to achieve a symmetrical injection pattern. The diameter of injection orifice 7 is smaller than the diameter of bore 35 and is preferably also smaller than the core diameter of threaded rod 36. Spray hole disc 42 may be manufactured inexpensively, e.g., as a punched part.

Threaded rod 36 pressed into the bore is shorter than bore 35. Between upstream side face **40*a* of threaded rod 36 and the upstream side of bore 35 there is a cavity 45, the height of which is determined by the distance between upstream side face 40*a* of the threaded rod and the upstream side of bore 35. When fuel injector 1 is opened, fuel is metered through a cylindrical lateral surface having the area $F=H\cdot 2R\pi$ through which the fuel is to flow, where H is the height of cavity 45 and R is the radius of overflow bore 33. The metered quantity of fuel may be set on the basis of the depth to which threaded rod 36 is pressed into the bore, its position defining height H of cavity 45**.

Swirl chamber 34 is situated downstream from threaded rod 36 and is formed between downstream side face **40*b* of threaded rod 36 and upstream side 41 of spray hole disc 42. The turbulence produced in the fuel flow is homogenized in swirl chamber 34 before the fuel flows through injection orifice 7** and is injected into the combustion chamber (not shown) of an engine.

To form asymmetrical injection patterns, the center axes of bores 35, 43 and of injection orifice 7 may differ with regard to angle and position. Turbulent fuel flow may be created through the use of threaded rods 36, the threads of which differ with regard to the ratio of the core diameter and the outside diameter and/or the pitch. Likewise, the influence of different lengths of threaded rods 36 and the associated difference in number of turbulence-producing threads may also be utilized.

What is claimed is:

1. A fuel injector for a fuel injector system of an internal combustion engine, comprising:

a valve-seat member including a valve-seat surface and an injection orifice;

a valve needle;

a valve-closure member that is mechanically linked to the valve needle and cooperates with the valve-seat surface of the valve-seat member to form a sealing seat; and a turbulence-producing element that is positioned in the valve-seat member downstream from the sealing seat;

wherein the turbulence-producing element including a threaded rod;

wherein the threaded rod is insertable from a downstream side of the valve-seat member into a bore in the valve-seat member; and wherein a cavity is present downstream from an overflow bore whose diameter is smaller than a core diameter of the threaded rod between an upstream side face of the threaded rod and the valve-seat member, a narrowest flow cross-section of the cavity defining a metering of a quantity of fuel to be injected.

2. The fuel injector according to claim 1, wherein a center line of the threaded rod forms a non-zero angle with a center line of the fuel injector.

3. The fuel injector according to claim 1, wherein a swirl chamber follows downstream from the threaded rod and is delimited in an axial direction by a downstream side face of the threaded rod and the valve-seat member.

4. The fuel injector according to claim 1, further comprising:

a spray hole disc, wherein a swirl chamber follows downstream from the threaded rod and is delimited in an axial direction by a downstream side face of the threaded rod and an upstream side of the spray hole disc.

5. The fuel injector according to claim 4, wherein the injection orifice is introduced into the spray hole disc.

6. The fuel injector according to claim 1, wherein a radial extent of the injection orifice is smaller than an outside diameter of the threaded rod.

7. The fuel injector according to claim 1, wherein the threaded rod is insertable from an upstream side of the valve-seat member into a bore in the valve-seat member.

8. The fuel injector according to claim 1, wherein the narrowest flow cross-section of the cavity is determined by an area F of a cylindrical lateral surface according to the equation $F=H*2R$, where H is an axial distance between the upstream side face and an upstream side of the bore, and R is the radius of the overflow bore.

9. The fuel injector according to claim 1, wherein a length of the threaded rod that is pressed in includes at least one complete thread.

* * * * *

UNITED STATES PATENT AND TRADEMARK OFFICE

CERTIFICATE OF CORRECTION

PATENT NO. : 6,851,629 B2
APPLICATION NO. : 10/149304
DATED : February 8, 2005
INVENTOR(S) : Hubert Stier et al.

It is certified that error appears in the above-identified patent and that said Letters Patent is hereby corrected as shown below:

On the title page, # (57) Abstract, line 1, delete "(1)"

On the title page, # (57) Abstract, line 2, delete "(4)"

On the title page, # (57) Abstract, line 3, delete "(3)"

On the title page, # (57) Abstract, line 4, delete "(6) (5)"

On the title page, # (57) Abstract, line 6, change "the valve-seat number (5)," to --the valve-set number,--

On the title page, # (57) Abstract, line 7, delete "(38)"

On the title page, # (57) Abstract, line 8, delete "(39)"

On the title page, # (57) Abstract, line 9, change "of the fuel injector (1)," to --of the fuel injector,--

On the title page, # (57) Abstract, line 9, delete "(36)"

On the title page, # (57) Abstract, line 10, delete "(5)"

Column 1, line 9, change "are German Published" to --are known from German Published--

Signed and Sealed this

Thirtieth Day of October, 2007

JON W. DUDAS
*Director of the United States Patent and Trademark Office*